US005316624A

United States Patent [19]

Racine

[11] Patent Number: 5,316,624

[45] Date of Patent: May 31, 1994

[54] METHOD AND APPARATUS FOR HIGH DENSITY PAPER

[75] Inventor: Jean-Guy Racine, Grand'Mere, Canada

[73] Assignee: Stone-Consolidated Inc., Canada

[21] Appl. No.: 855,476

[22] Filed: Mar. 23, 1992

Related U.S. Application Data

[63] Continuation of Ser. No. 596,403, Oct. 3, 1990, abandoned, which is a continuation of Ser. No. 403,777, Sep. 8, 1989, abandoned, which is a continuation of Ser. No. 118,176, Nov. 9, 1987, abandoned, which is a continuation of Ser. No. 942,393, Feb. 9, 1987, abandoned, which is a continuation of Ser. No. 826,818, Feb. 6, 1987, abandoned, which is a continuation of Ser. No. 649,986, Sep. 13, 1984, abandoned.

[51] Int. Cl.[5] ..... D21F 11/00

[52] U.S. Cl. ..... 162/205; 162/206

[58] Field of Search ..... 162/150, 206, 205; 100/161, 163 R

[56] References Cited

U.S. PATENT DOCUMENTS

| | | | |
|---|---|---|---|
| 1,862,686 | 6/1932 | Boyer | 162/206 |
| 2,211,348 | 8/1940 | Nelson | 162/206 |
| 3,759,785 | 9/1973 | Mihelich | 162/206 |

FOREIGN PATENT DOCUMENTS

| | | | |
|---|---|---|---|
| 685634 | 5/1964 | Canada | 162/206 |
| 47-38882 | 10/1972 | Japan | 162/206 |

*Primary Examiner*—Peter Chin

[57] ABSTRACT

A method and apparatus to produce a relatively dense high quality paper suitable for multi-color printing are provided. The paper web is super/soft-calendered while at a moisture content of between about 15 to about 55% and the web is subsequently treated to further reduce its moisture content. This procedure prevents galvanizing of the sheet which normally would occur using prior art techniques.

12 Claims, 2 Drawing Sheets

(DATA FROM TABLES 1 & 2)

(DATA FROM TABLE 3)

(DATA FROM TABLE 4)

METHOD AND APPARATUS FOR HIGH DENSITY PAPER

Figure 1:
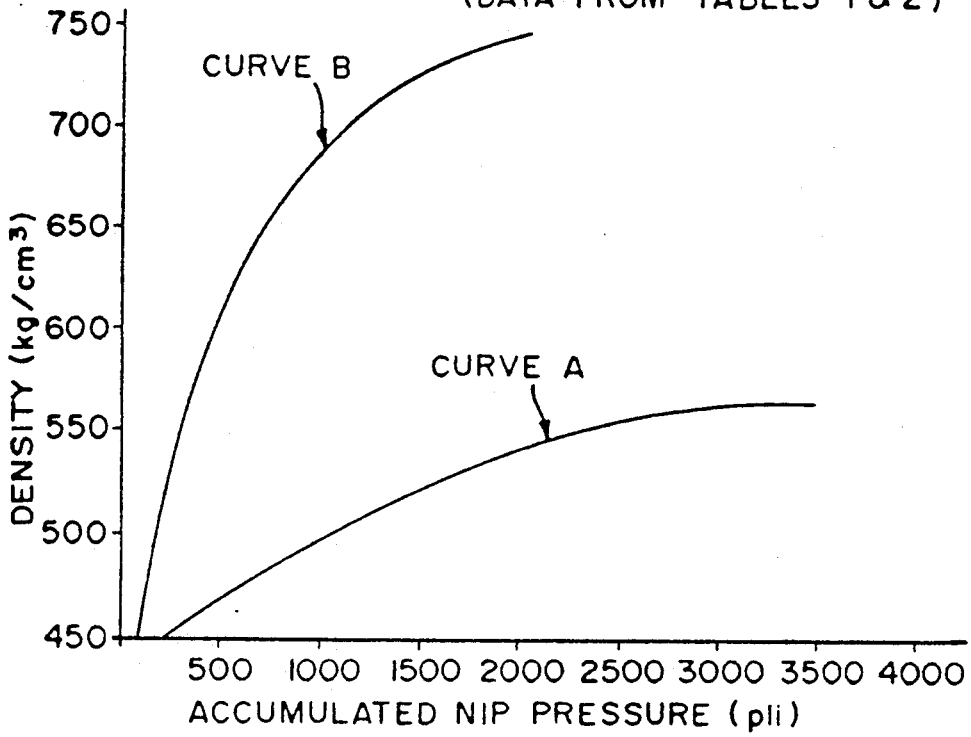

This application is a continuation of application Ser. No. 07/596,403, filed Oct. 3, 1990 abandoned which is a continuation of Ser. No. 07/403,777, filed Sep. 8, 1989, abandoned which is a continuation of Ser. No. 07/118,176, filed Nov. 9, 1987 abandoned which is a continuation of Ser. No. 07,942,393, filed Feb. 9, 1987, abandoned which is a continuation of Ser. No. 07/826, 818, filed Feb. 6, 1987, abandoned which is a continuation of Ser. No. 06/649,986, filed Sep. 13, 1984, abandoned.

The present invention relates to a method and apparatus and more particularly, relates to a method and apparatus to produce a relatively dense high quality paper.

In general, the manufacture of paper involves allowing a dilute water suspension of wood pulp fibers to flow onto a travelling open mesh wire screen through which a large portion of the liquid passes. It is also known in the art to flow the dilute water suspension of wood pulp fibers between two such screens. Further moisture is often removed through processing steps such as the application of vacuum and/or by the application of pressure. Thus, one may pass the wet web through nips formed by opposing rolls, i.e. wet pressing. It is also known to further reduce the moisture content of the paper web by passing the web over rotating heated cylinders where, through evaporation, the moisture content may be reduced to a figure of less than 15%.

In the paper-making process it is often desirable or required to improve specific properties of the paper web. Thus, a problem which has recently been encountered in the art is that, with the introduction of high speed printing, a higher quality paper is required. Specifically, a paper having a higher density along with a relatively low moisture content is a prerequisite for certain types of printing. For example, when printing a sheet in multi-colour, subsequent to the application of a first colour, the printed sheet is passed through a drying step prior to the next colour being applied thereto. Should the moisture of the sheet entering the drying step be too high (e.g. above 8%), the sheet will shrink during the dry step and will not be in registry for application of the next colour.

In other words, for certain printing requirements, it is desirable to have a paper web with a high density and low moisture content. In order to achieve the higher density without crushing the paper web, it has been proposed to increase the moisture when machine calendering so as to facilitate a compacting step. However, this leads to blackening/mottling of the paper and acts in opposition to the desirability of having a low moisture content. In order to achieve the desired results, one must operate a relatively expensive process using a plurality of highly structured steps.

It is an object of the present invention to provide a method and apparatus for producing a paper web which has a relatively high density and low moisture which paper web is suitable for multi-colour printing.

There is provided an improved method for producing a high quality paper suitable for multi-colour printing, which method includes the steps of preparing a pulp furnish of fibers, forming a wet paper web from the furnish, removing moisture, if necessary, from the wet paper web to reduce the moisture content thereof to between about 55% to about 15%, super/soft calendering the web to increase substantially the web density, and treating the web to reduce its moisture content.

There is also provided an improvement in a paper-making apparatus, which apparatus includes means for preparing a pulp furnish of fibers, means for forming a wet paper web from the furnish, means for removing moisture from the wet paper web to a level of between about 55% to about 15%, the improvement comprising means for super-calendering the paper web, while the paper web has a moisture content of between about 55% to about 15%, to increase substantially the density of the web.

As previously mentioned, in the paper-making process it is often desirable to improve specific properties of the paper web and thus, the paper web is often subjected to a calendering operation wherein the web is passed through successive nips formed between heavy rotating rolls in a calender stack. In this respect, one may subject the dried paper web to either a "hard" or "super" calendering step. A hard calendering step operation comprises passing the paper web between paired rolls, the surface of each being formed of a hard non-resilient material. Super calendering (also referred to as soft calendering), on the other hand, takes place between a pair of rolls wherein the surface of one of the rolls is made of a hard non-resilient material while the surface of the opposed roll is made of a firm resilient material. The calendering operations can take place "in line" with the other steps of the paper-making process—in other words, along with the web forming, pressing and drying steps and is thus referred to as on-machine calendering. If the calendering is not done in line, it is referred to as off-machine calendering. As presently practiced in the paper-making art, super calendering is usually performed off machine.

Other calendering and/or wet pressing operations or similar type operations are also known in the art. Thus, in situations where the wire or the dandy roll or the press felt leaves marks on the wet web, it is sometimes desirable to remove these marks while the web is highly plastic. In such an instance, a smoothing press is used immediately before the drying section; the smoothing press consists of two rolls similar to plain press rolls except that no felt is used and the wet web is very lightly pressed between two very hard surfaces. These surfaces are usually made from a metallic or granite material and in some instances, a very hard rubber material has been used. More recently, especially for groundwood paper a calendering operation within the drier section itself is being used. The point at which the calendering is done will depend on the paper properties desired and this operation is referred to as breaker (stack) calendering. This breaker calendering operation is performed utilizing essentially the same equipment as that used for machine calendering—i.e. hard calendering where the surface of the nip rolls are both made of hard non-resilient material. While the main function of breaker calendering is to smooth out the sheet and level out any high spots, low nip pressures have to be used to avoid sheet damage, mottling or blackening, since the moisture content can be high and the web weak.

As may be seen from the above, hard calendering may be utilized both within the drier section and subsequent to the drying step. Generally, breaker calendering utilizes only very low nip pressures while machine calendering (hard calendering) is utilized with moistures below 15%, and low to high nip pressures. Super calendering, on the other hand, is generally only utilized in the low moisture range, usually off-machine. Other types of calendering, such as gloss calendering or similar "finishing" operations, in which a substantial reduction in thickness/caliper or substantial increases in density are not effected (because of various problems e.g. "glossy"/mottle surfaces, etc.) also employ soft calendering techniques, at moisture below 15%. Commercial application usually involves paperboard grades. This is known, for example, in U.S. Pat. No. 3,124,504. In the disclosure of this patent, it is taught that a nip involving a hard metal surface and a hard resilient surface may be utilized to impart certain surface characteristics to an uncoated web. They do not teach any desirability of achieving a substantial reduction in the thickness or thereby an increase in the density of the web which is the aim of applicant. Applicant, on the other hand, achieves a substantial reduction. For gloss or similar calendering operations a decrease in thickness (or an increase in density) of over 5–10% is considered a substantial decrease (or increase) depending on the grade of paper or paperboard.

Furthermore, Mahoney et al do not give data to support their process and inquiries indicate that there has been no commercial success with this process. This lack of commercial success is supported by Mihelich in his U.S. Pat. No. 3,759,785 where his soft calendering process could only be applied to an uncoated paper (newsprint) in a moisture range of up to 12 to 15% (lines 23–25, col. 8).

In view of the above, it is therefore important to note that the terms "compacting/calendering/soft-calendering/calenders" as used by applicant in the present invention excludes those pressing/calendering operations that involve the following: wet pressing/wet presses; smoothing/smoothing presses/calenders; finishing/gloss calendering/gloss calenders.

The present invention, as previously mentioned, utilizes a wet paper web which preferably has a moisture content of between about 55% to about 15%. This wet paper web may be furnished by conventional means—as in conventional paper-making operations, a dilute water suspension of the pulp fibers may be caused to flow onto a travelling open mesh wire screen to permit removal of a substantial portion of the water through the screen. Further water may be removed by conventional steps such as the application of vacuum or the use of press rolls or other steps to partially dry the web to the desired moisture content. If desired, the web may be additionally treated to increase its integrity.

The web, while at a moisture content of between about 55% to about 15% is subject to an on-machine super-calendering operation. Thus, the paper web, at the desired moisture content, is passed between a pair of rolls, one of which is made of a hard non-resilient material such as a metallic material and an opposed roll made of a firm resilient material. While the materials of which the rolls may be formed are known in the art and the terms "soft" and/or "super" calendering are well known to those knowledgeable in the art, more specific aspects are discussed below.

As mentioned above, there are a number of variables/parameters involved in calendering, many of which interact in a highly complex way and on which subject much has been written. However, one parameter is of interest here, namely the hardness and nature of the material of which the resilient roll surface is made. There are those materials, which are commonly referred to as "cotton filled", others are referred to as "elastomeric". A particular elastomeric material or calender roll which has been found to be useful for the present invention is that made by Edouard Kusters (West Germany) and sold by that company under the Trade Name of "MAT-ON-LINE".

As aforementioned, the paper web may be subjected to the super calendering step while having a moisture content of between about 55% to about 15%. While applicant has found that his invention works within the moisture range of about 55% to about 15%, the low moisture limit is really that limit beyond which the prior art itself found it could not work effectively without sheet blackening taking place. The higher moisture level, on the other hand, was found to be that level where no further moisture could be extracted by the usual wet pressing operations; furthermore, depending on prior compacting/drying steps, it was found to be the point where the integrity/strength of the web was sufficient for it to withstand a soft-calendering operation/step. This moisture level was also found to be largely dependent on the nature of the web furnish. While web adhesion to the rolls can be severe at these high moistures, release agents/surfaces can be used effectively to counteract this, otherwise it, too, can determine the high moisture limit.

It is preferred however that the super calendering be done while the moisture content of the paper web is between about 20% to about 45%. The optimum specific moisture content for any particular paper web will, however, depend on many variables or parameters. Thus, one must take into account factors such as the machine speed, the nip pressure load, the roll diameter, the number of nips through which the web is passed, the calendering temperature, the type of furnish used for the web itself, the nature and hardness of the surface of the resilient roll, etc.

The temperature of the web entering the nip will also depend on other factors. Thus, one could utilize steam showers to increase the moisture and temperature of the web up to near the boiling point of water and by utilizing a compartmental steam box and varying the steam at various locations, one could control the nip pressure profile of the super calendering operation. However, one limiting factor for the calendering temperature would be the type of material utilized to create the firm resilient roll surface for the super calendering step. When elastomeric materials are used, too high a temperature would deleteriously affect the roll surface/bonding between the elastomer and the metallic core. Also, too high a temperature might tend to dry out the sheet while it is being processed. Nevertheless, by controlling both the web temperature and the temperature of the surface of each of the mating rolls, applicant found he could control the overall soft calendering temperature. Thus, within the temperature limitation of the resilient roll surface, applicant found that by using higher calendering temperatures, he was able to decrease the nip pressure intensity/charge for a given compacting action or conversely obtain greater compacting for a given nip charge, all in the interest of a higher quality sheet.

Another embodiment that applicant found advantageous, was to divide the soft calendering operation at the higher moistures into two or more stages, with or without inter-stage drying. For example, a light soft calendering stage in the 45 to 55% moisture range where the density would be increased by 10 to 20%, this would be followed by drying the web to moisture within the 25 to 35% range, to be followed by a heavier soft calendering stage/step where the density would be further increased. While infra-red drying can be used to good effect in this embodiment, it is preferable to use a drying technique where the web is held under pressure while it dries, e.g. a dryer felt and cylinder combination. Embodiments involving a combination of applicant's novel soft calendering step with other prior art calendering steps are disclosed below with the accompanying data.

Figure 2:
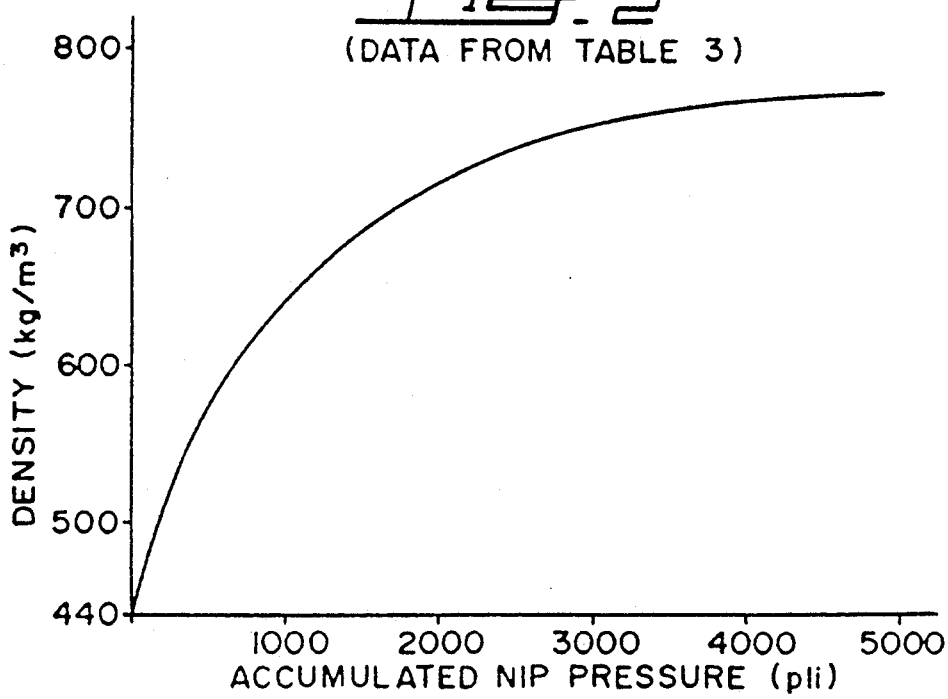
Figure 3:
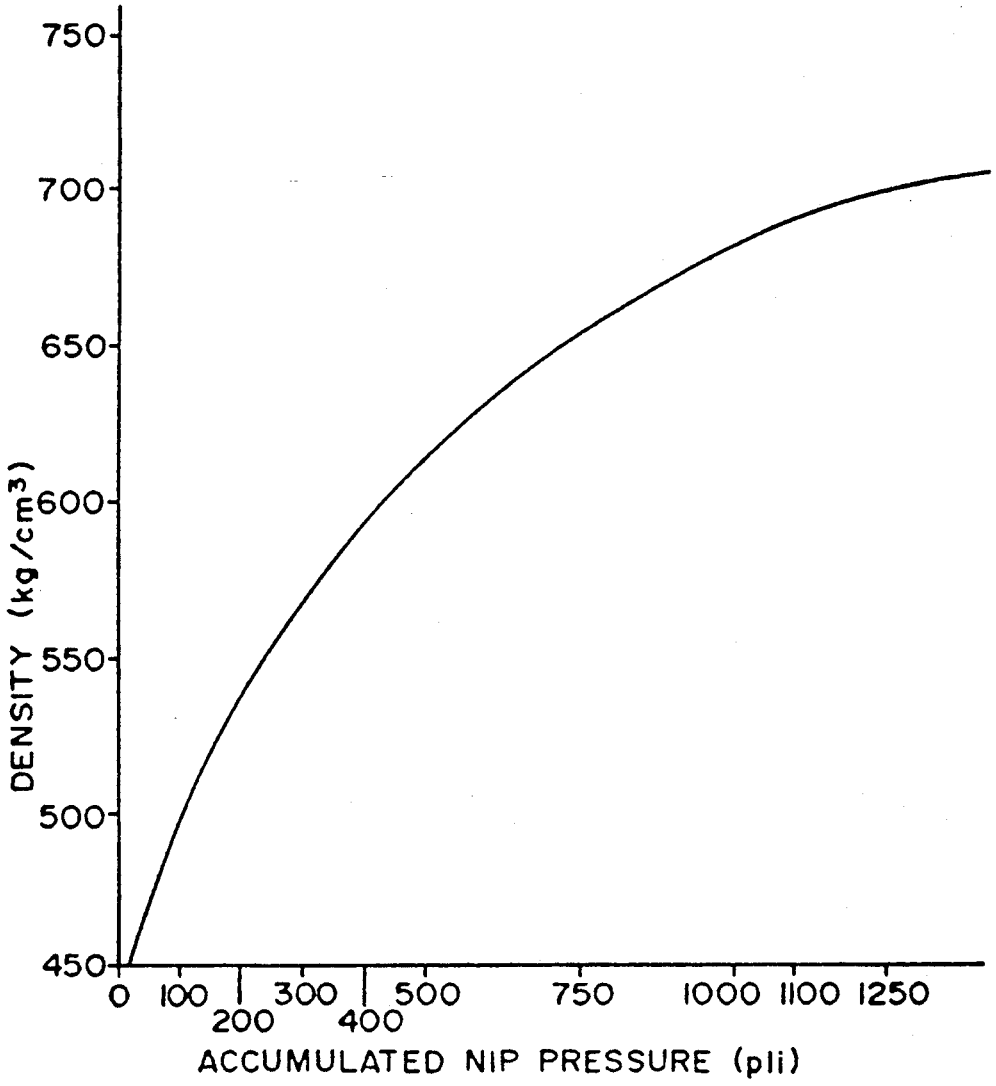

Having thus generally described the invention, reference will be made to the accompanying drawings illustrating the practice of the invention, and in which:

FIGS. 1, 2 and 3 are graphs showing the relationship between accumulated applied nip pressure charge versus sheet density according to various embodiments.

In a first test embodiment, a commercially produced newsprint web was subjected to a super calendering step on pilot plant machinery. The web had an initial moisture content of 9%; the paper web was subjected to a plurality of passes through nips with varying nip pressures as are set forth in Table 1 and plotted in FIG. 1 (curve A). A sample of the paper web was tested for various properties as set forth hereinbelow.

TABLE 1

| SAMPLE | 00 | 0 | 1 | 2 | 3 | 4 | 5 | 6 | 7 |
|---|---|---|---|---|---|---|---|---|---|
| Nips × pli (per nip) | 0 | 3 × 61 (av) | 2 × 280 | 2 × 560 | 2 × 840 | 2 × 1120 | 2 × 280 | 2 × 560 | 2 × 840 |
| Acc. Nip Charge (pli) | 0 | 183 | 743 | 1303 | 1863 | 2423 | 743 | 1303 | 1863 |
| Nip Temp °C. | | | 65 | 65 | 65 | 65 | 100 | 100 | 100 |
| Basis Weight (g/m$^2$) | 48.8 | 46.8 | 47.6 | 47.9 | 47.5 | 48.1 | 48.1 | 47.8 | 47.3 |
| Caliper (um) | 108 | 103.9 | 96.9 | 92.0 | 88.4 | 87.3 | 95.9 | 88.9 | 85.2 |
| Density (kg/m$^3$) | 452 | 450 | 491 | 520 | 5 38 | 551 | 504 | 537 | 555 |
| Corr. Density (kg/m$^3$) | | 450 | 483 | 508 | 530 | 536 | 490 | 526 | 549 |
| PSS (um) felt | | 6.76 | 5.95 | 4.96 | 4.52 | 4.35 | 5.49 | 4.69 | 4.37 |
| PPs (um) wire | | 7.38 | 6.44 | 5.94 | 5.34 | 4.83 | 6.08 | 5.41 | 4.96 |

| SAMPLE | 8 | 9 | 10 | 11 |
|---|---|---|---|---|
| Nips × pli (per nip) | 2 × 1120 | 4 × 560 | 4 × 840 | 4 × 1120 |
| Acc. Nip Charge (pli) | 2423 | 2423 | 3543 | 4663 |
| Nip Temp °C. | 100 | 100 | 100 | 100 |
| Basis Weight (g/m$^2$) | 47.2 | 47.9 | 47.7 | 47.5 |
| Caliper (um) | 83.1 | 87.4 | 83.9 | 81.7 |
| Density (kg/m$^3$) | 568 | 547 | 568 | 581 |
| Corr. Density (kg/m$^3$) | 563 | 535 | 557 | 573 |
| PSS (um) felt | 4.15 | 4.57 | 4.16 | 4.34 |
| PPs (um) wire | 4.52 | 4.88 | 4.33 | 3.98 |

Corr. Density = D × BW°/BWs
00 Sample = before any calendering is done
0 Sample = after several nips in the machine calender
PPS = Parker Print-Surf test in microns Subsequently, a web of newsprint was removed from a commercial paper machine at the breaker stack location at a moisture of approximately 31%. By the time the web was prepared for further processing on the pilot plant machinery, the moisture had dropped to a range of 25–30%. This moist paper web was then subjected to a soft calendering step similar to the previous embodiment with the parameters and results being set forth below in Table 2, and plotted in FIG. 1 (curve B).

TABLE 2

| SAMPLE | 00 | 0 | 1 | 2 | 3 | 4 | 5 | 6 | 7 | 8 | 9 |
|---|---|---|---|---|---|---|---|---|---|---|---|
| Nips × pli (per nip) | 0 | 1 × 150 | 1 × 150 | 1 × 350 | 1 × 500 | 2 × 350 | 1 × 850 | 1 × 850 | 2 × 500 | 2 × 850 | 2 × 850 |
| Acc Nip Charge (pli) | 0 | 150 | 150 | 350 | 500 | 700 | 850 | 850 | 1000 | 1700 | 1700 |
| Caliper (um) | 108 | 98.7 | 102.5 | 84.7 | 80.0 | 77.8 | 70.5 | 71.5 | 72.9 | 66.4 | 65.5 |
| Density (kg/m$^3$) | 452 | 494 | 477 | 576 | 610 | 627 | 692 | 682 | 670 | 735 | 745 |

00 Sample = before any calendering is done.

In the next test embodiment, the moist paper web was again taken from a commercial paper machine at the breaker stack location with the same moisture content as the sample for Table 2. The sample was subjected to a soft calendering operation at a moisture content of between 22–23%, air dried to approximately 9–10% moisture and then subjected to a further soft calendering operation. The results are given below in Table 3 and plotted in FIG. 2.

TABLE 3

| SAMPLE | 00 | 0 | 2 | 3 | 4 | 5 |
|---|---|---|---|---|---|---|
| SB Nips × pli (per nip) | 0 | 1 × 850 | 1 × 850 | 2 × 850 | 1 × 850 | 2 × 850 |
| SM Nips × pli (per nip) | 0 | | 2 × 850 | 2 × 850 | 4 × 850 | 5 × 850 |
| Acc. Nip Charge (pli) | 0 | 850 | 2550 | 3400 | 4250 | 5100 |
| Caliper (um) | 108 | 71.5 | 64.1 | 62.0 | 61.4 | 62.0 |
| Density (grm/cm$^3$) | 452 | 683 | 761 | 787 | 795 | 787 |
| PPS felt (um) | | | 2.76 | 2.26 | 2.48 | 2.5 |

TABLE 3-continued

| SAMPLE | 00 | 0 | 2 | 3 | 4 | 5 |
|---|---|---|---|---|---|---|
| PPS wire (um) | | | 2.90 | 2.39 | 2.46 | 2.5 |

SB = Soft calendering at a moisture above 15% (e.g. at the Breaker Stack)
SM = Soft calendering at a moisture below 15% (e.g. at the Machine Stack)

A further test embodiment was run similar to that of examples 2 and 3 again utilizing a web of newsprint from a commercial paper machine at the breaker stack location. In this embodiment, the paper web was subjected to an initial soft calendering operation at a moisture content of 22-23%, air dried to around 9-10% and then subjected to a final hard calendering at the reduced moisture level. The results are shown in Table 4 below and plotted in FIG. 3.

TABLE 4

| SAMPLE | 00 | 0 | 1 | 2 | 3 | 4 |
|---|---|---|---|---|---|---|
| SB Nips × pli (per nip) | 0 | 2 × 350 | 2 × 350 | 2 × 350 | 2 × 500 | 2 × 500 |
| HM Nips × pli (per nip) | 0 | | 3 × 50 | 5 × 50 | 3 × 50 | 5 × 50 |
| Acc. Nip Charge (pli) | 0 | 700 | 850 | 950 | 1150 | 1250 |
| Caliper (um) | 108 | 77.8 | 73.1 | 72.0 | 70.6 | 69. |
| Density (grm/cm$^3$) | 452 | 627 | 668 | 678 | 691 | 698 |
| PPS felt (um) | | | | 3.20 | | 3. |
| PPS wire (um) | | | | 3.52 | | 3. |

SB = Soft calendering at a moisture above 15% (e.g. at the Breaker Stack)
HM = Hard calendering at a moisture below 15% (e.g. at the Machine Stack)

Referring to FIG. 1, curva A indicates how the density of the web increases as the web is subjected to prior process of off-machine super calendering at a low moisture content—approximately 9%. Curve B, on the other hand, shows the increasing density of the web as it is subjected to the process of the present invention—on-machine soft calendering at a higher moisture content (25-30%). In comparing curves A and B, it is evident that one can obtain a higher density web more readily with the same "accumulated nip charge" using the practice of the present invention.

Thus, referring back to Table 1 (curve A) the density for sample 11 represents a "standard news" sheet and not that of a higher quality roto-gravure sheet which is achieved in samples 5 to 9 in Table 2.

FIG. 2 and Table 3 illustrates that one is able to obtain a sheet with super quality roto grade equivalent through the practice of the present invention combined with super calendering subsequent to the steps of breaker stack super calendering and air drying. In this process the density was increased about 80%.

FIG. 3 and Table 4 illustrates that one can obtain a good quality roto sheet with the combination of super calendering at a higher moisture, air drying, and then hard calendering with several light nips. In general, the use of the super calendering at higher moistures reduces substantially the number of nips/the magnitude of nip pressure that is required for the final calendering of the sheet. Since calendering, especially hard calendering, can be a damaging and expensive operation, this is extremely useful.

Referring back to Tables 3 and 4, comparing the results of super calendering versus hard calendering (both at low moistures) after soft calendering at higher moistures by applying an ink film with a special draw bar to the samples, it was found that the hard calendering still had a greater mottling propensity than that for the soft calendering which showed no mottling whatsoever. Thus, while prior art processes could produce a high density paper, mottling or "galvanizing" still plagued these attempts. The present invention, it is clear, eliminated this mottling effect which made high quality printing very difficult if not impossible. In addition, the density profile is more uniform and the surface more "flat".

The apparatus for soft calendering is well known in the art and thus, reference may be had to Kusters U.S. Pat. Nos. 3,365,774 and 4,256,034 and Mahoney et al U.S. Pat. No. 3,124,504 as examples of a suitable type of apparatus. While the above examples have dealt with newsprint grades of paper, other grades of paper and paperboard, covering a wide caliper or thickness range, could equally well be used, when a higher density is required together with acceptable printing characteristics.

As will be seen from the above, in the practice of the present invention, a substantial increase in the density is achieved using a super/soft calendering operation. The web "remembers" the previous calendering operation to which it has been subjected and it has been found that it is the total nip pressure to which the web has been subjected throughout the super/soft calendering which is extremely important.

It will also be apparent that other changes and modifications may be made to the above described specific embodiments without departing from the spirit and scope of the invention.

I claim:

1. A process for making paper which is adapted to receive print or graphics which process comprises the steps:

(1) preparing a pulp furnish of fibers, (2) providing a pressed wet paper web prepared from said furnish having a moisture content greater than 15% by weight, (3) soft calendering said wet paper web while maintaining the moisture content of said web at a level greater than 15% by weight, said soft calendering occurring at a calendering pressure and temperature sufficient to increase the density of the web by at least about 10% yet insufficient to cause galvanizing of the paper web, and (4) subsequently treating said calendered web to further reduce its moisture content.

2. The process of claim 1 wherein said treated web of step (4) is further calendered in a soft calendering step.

3. The process of claim 1 wherein said treated web of step (4) is further calendered in a hard calendering step.

4. The process of claim 1 wherein said web is dried in said step (4) to a moisture content of below 15%.

5. The process of claim 1 wherein the moisture content of said web is maintained between greater than 15 and up to about 45% during said soft calendering of step (3).

6. The process of claim 1 wherein the density of said web is increased up to about 80% as a result of said soft calendering of step (3).

7. The process of claim 1 wherein step (3) comprises soft calendering said web in a first soft calendering step whereby the density of the web is increased, drying said soft calendered web, and soft calendering said web in a second soft calendering step to further increase the density of the web.

8. The process of claim 7 wherein the density of the web is increased from about 10 to 20 percent in said first calendering step, and further increased in said second calendering step.

9. The process of claim 2 wherein said calendering step is conducted at a moisture content of less than 15%.

10. The process of claim 3 wherein said calendering step is conducted at a moisture content of less than 15%.

11. The process of claim 1 wherein said pressed web paper web of step (2) is dried to reduce the moisture content of same to between greater than 15% to about 55% by weight prior to step (3).

12. The process of claim 1 wherein said wet paper web of step (2) has a moisture content within the range of from greater than 15% to about 55%.

* * * * *